US005580284A

United States Patent [19]

Laricchia

[11] Patent Number: 5,580,284

[45] Date of Patent: Dec. 3, 1996

[54] ELECTRICAL WIRE CONNECTOR

[75] Inventor: Rocco V. Laricchia, Pickering, Canada

[73] Assignee: The Whitaker Corporation, Wilmington, Del.

[21] Appl. No.: 399,671

[22] Filed: Mar. 7, 1995

[51] Int. Cl.[6] ..... H01R 4/50

[52] U.S. Cl. ..... 439/783; 439/796

[58] Field of Search ..... 439/783, 796

[56] References Cited

U.S. PATENT DOCUMENTS

| | | | |
|---|---|---|---|
| 3,235,944 | 2/1962 | Broske et al. | 439/783 |
| 3,491,331 | 5/1967 | Glader | 439/783 |
| 3,891,297 | 6/1975 | Poliak et al. | 439/657 |
| 4,415,222 | 11/1983 | Polidori | 439/807 |
| 4,600,264 | 7/1986 | Counsel | 439/783 |
| 4,687,273 | 8/1987 | Pranch | 439/411 |
| 4,813,894 | 3/1989 | Mixon, Jr. | 439/783 |
| 4,857,020 | 8/1989 | Crosby | 439/783 |
| 5,092,797 | 3/1992 | Cole et al. | 439/783 |

FOREIGN PATENT DOCUMENTS

| | | | |
|---|---|---|---|
| 0238316 | 9/1987 | European Pat. Off. | H01R 23/02 |
| 2202389 | 9/1988 | European Pat. Off. | H01R 13/40 |

*Primary Examiner*—P. Austin Bradley
*Assistant Examiner*—T. C. Patel

[57] ABSTRACT

A wire connector (10) is provided for electrically interconnecting two or more conductors (18, 20) together. The wire connector includes a clamping member (14) having a tapered wall (36) that completely surrounds an internal cavity (42). The cavity (42) includes channels (48, 54) for receiving the conductors. A tapered wedge (16) having similar channels (64, 72) is arranged to enter the cavity (42) and wedge the conductors (18, 20) between the surfaces of the clamping member channels and the wedge channels thereby completing the desired interconnection. A bolt (22) extending through the clamping member and wedge is threaded into a nut (24) to hold the parts together. An insulating cover (12) is provided to slip over and latch to the assembly.

17 Claims, 4 Drawing Sheets

ELECTRICAL WIRE CONNECTOR

The present invention relates to wire connectors, for electrical distribution systems, of the type having an outer clamping member and a wedge for interconnecting two or more conductors.

BACKGROUND OF THE INVENTION

When routing electrical power to a series of electrical devices such as street lights, the power conductor is brought into the base of the unit, electrically interconnected to a tap wire that is routed to the lamp itself, and another power conductor that is routed to the next street light. The electrical interconnection can be made with wire nuts if the combination of wire sizes is not too large, or, more typically, it can be made with either a terminal block or a split bolt splice. The terminal block is a metal block having holes formed therein for receiving the individual conductors to be interconnected. Each hole has a set screw that intersects the hole at a right angle for tightening against the conductor and holding it in the terminal block. The set screw, however, tends to damage the surface of the conductor, and the length of the area of contact between the conductor and the inside surface of the hole is relatively small. When the conductor is inserted into the hole and the set screw tightened, any oxide layer present on the surfaces of the conductor and the hole will remain tending to provide a higher resistance path than would otherwise be the case if the oxide layers were not there. The point of contact between the set screw and the conductor is the only low resistance contact. The split bolt device, on the other hand, utilizes a nut and bolt arrangement where the bolt is split for receiving the conductors to be spliced. The conductors are inserted into the opening in the split bolt and the nut tightened to force the conductors against the head of the bolt. As with the terminal block, any oxide layers present will be trapped within the connection resulting in a high resistance contact, and the nut tends to damage the conductor's surface. This structure requires that the conductors be clamped against each other so that if they are of dissimilar material, galvanic corrosion problems may occur. Additionally, the surface area of electrical contact is relatively small.

What is needed is a wire connector that separately clamps each conductor, provides a wiping action as the conductors are being interconnected to remove any oxide that may be present without damage to the conductors, and that provides a relatively large area for electrical contact to assure proper current flow through the connector.

SUMMARY OF THE INVENTION

An electrical wire connector is disclosed for electrically interconnecting at least one first conductor and one second conductor. The wire connector includes a clamp member having a first end, a second end, and a longitudinal axis extending through the first and second ends. A continuous peripheral wall extends from the first end to the second end completely encircling the axis. The wall has an outer surface and an inner surface defining an interior cavity. A substantially straight first conductor receiving channel and a substantially straight second conductor receiving channel are formed in the interior wall. The first and second channels extend from the first end to the second end, the first channel diverging from the first end outwardly away from the axis toward the second end. A wedge is provided having a third channel and a fourth channel. The wedge is conformably received in a closed position within the interior cavity of the clamping member wherein the third channel is in opposed relationship with the first channel for receiving and clamping a first conductor therebetween and the fourth channel is in opposed relationship with the second channel for receiving and clamping a second conductor therebetween. A coupler is arranged to force the wedge into the interior of the clamping member and into the closed position, the coupler securing the wedge and clamping member together. Upon moving the wedge into the closed position within the clamping member, the first and second conductors are clamped tightly into respective channels of the clamping member and the wedge.

DESCRIPTION OF THE PREFERRED EMBODIMENT

Figures 1, 2, 3:
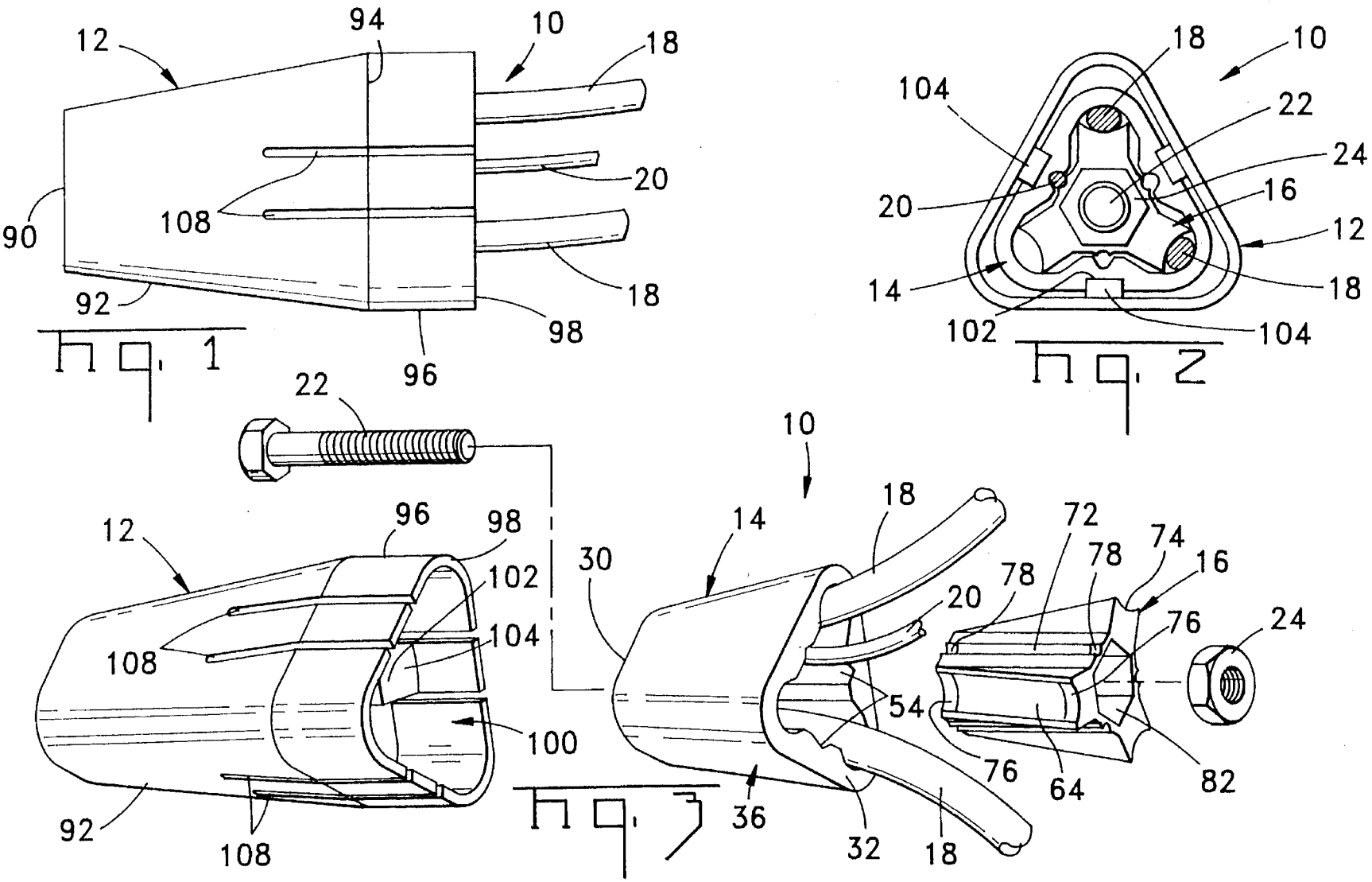
FIG. 1 is a side view of a wire connector incorporating the teachings of the present invention.
FIG. 2 is an end view of the wire connector shown in FIG. 1.
FIG. 3 is an exploded parts isometric view of the wire connector shown in FIG. 1.
Figure 7:
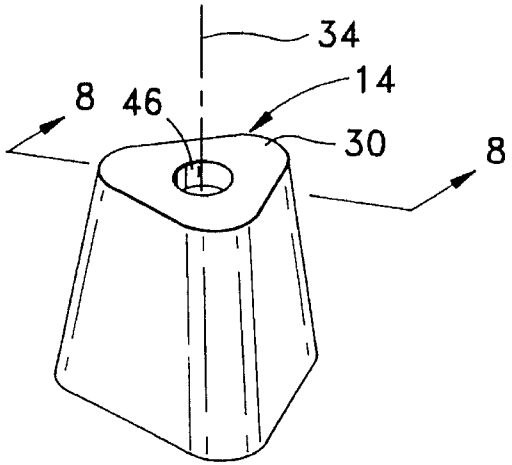
FIG. 7 is an isometric view of the clamping member shown in FIG. 4.

There is shown in FIGS. 1, 2, and 3, a wire connector 10 having an outer insulating cover 12, a clamping member 14, and a wedge 16. The wire connector 10 is arranged to electrically interconnect several first conductors 18 and several second conductors 20. While the connector 10 may be configured to accommodate a large number of conductors, there is a maximum of three first conductors and three second conductors that can be accommodated in the connector 10 as depicted, although there are only two first conductors and one second conductor shown in the present example. As will be explained, other configurations of the wire connector 10, will be able to accommodate fewer or more first and second conductors. The clamping member 14 and wedge 16 are secured in clamping engagement with the first and second conductors 18 and 20 by means of a coupler, such as a bolt 22 and mating nut 24, as will be explained in more detail below.

Figure 6:
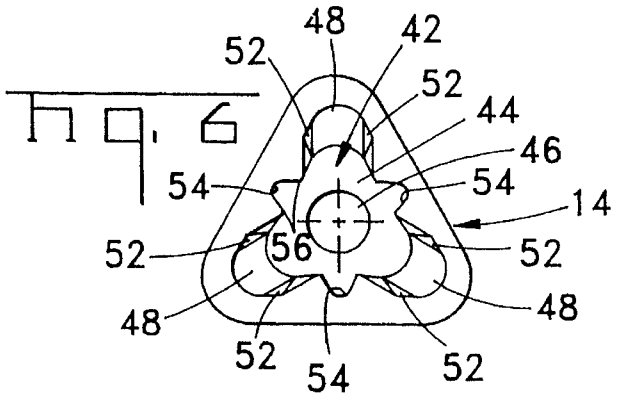
FIGS. 4, 5, and 6 are left side, front, and right side views, respectively, of the clamping member.
Figure 8:
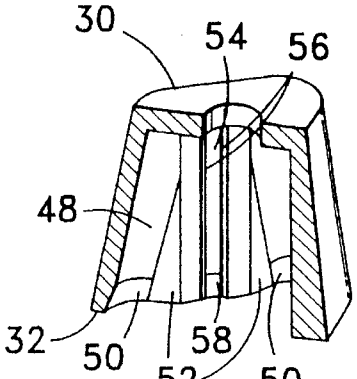
FIG. 8 is a cross-sectional view taken along the lines 8—8 in FIG. 7.
Figure 5:
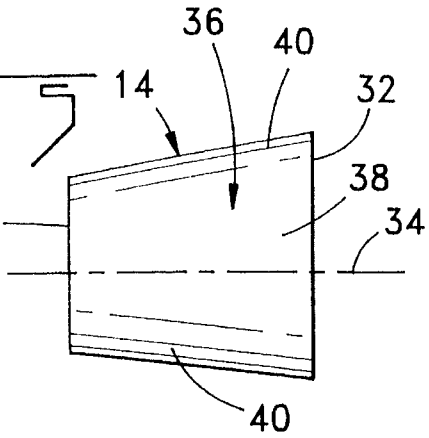

The clamping member 14, as best seen in FIGS. 4 through 8, has first and second ends 30 and 32, respectively, a longitudinal axis 34 extending through the first and second ends, and a continuous peripheral wall 36 that completely encircles the axis 34. The wall 36 extends from the first end 30 to the second end 32 and has an outer surface with three equally spaced relatively flat sides 38 joined by three equally spaced radiused corners 40, thereby forming a three sided polygon. Note that the outer surface of the wall 36 diverges or tapers from the first end 30, outwardly away from the axis 34 toward the second end 32, although, it need not do so. The wall 36 includes an inner surface that defines an interior cavity 42 that extends from the second end 32 to an end wall 44 at the first end 30. A clearance hole 46 is formed through the end wall 44 coaxial with the axis 34 for receiving the bolt 22. The interior surface of the wall 36 includes three concave first channels 48, each of which has a radius that is slightly larger than the radius of the largest first conductor 18 to be clamped in the wire connector 10. The three first channels 48 extend from the end wall 44, diverging outwardly away from the axis 34, to the second end 32. Each first channel 48 includes a short bevel 50, as best seen in FIG. 8, to serve as a lead in for the first conductors 18 and to lessen the chance of nicking the conductor during installation of the wire connector 10 and during use. Each first channel 48 includes an abutting surface 52 on each side thereof for a purpose that will be explained. The interior surface of the wall 36 also includes three concave second channels 54, each of which has a radius that is slightly larger than the radius of the largest second conductor 20 to be clamped in the wire connector 10. The three second channels 54 extend from the end wall 44, diverging outwardly away from the axis 34, to the second end 32. The three second channels diverge outwardly toward the second end only slightly to provide a proper draft angle during casting of the part. Each second channel 54 includes an abutting surface 56, as best seen in FIGS. 6 and 8, on each side thereof for a purpose that will be explained, and includes a beveled surface 58 adjacent the second end 32 to serve as a lead in for the second conductor 20. Note that the interior surface of the wall 36 that defines the interior cavity 42 has the first and second channels alternately spaced so that each second channel 54 is between two first channels 48. The first channels 48, which are arranged to accommodate conductor sizes from #4 gage to #1/0 gage, are of a larger radius than the second channels 54, which are arranged to accommodate conductor sizes from #12 gage to #14 gage. The clamping member 14 is cast of a high strength aluminum alloy, steel, or copper.

Figure 12:
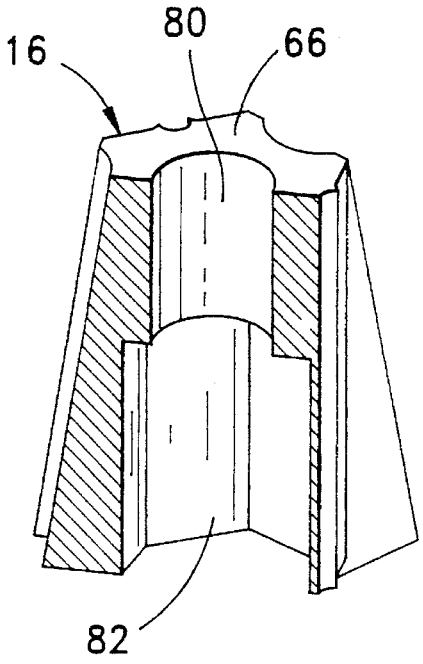
FIG. 12 is a cross-sectional view taken along the lines 12—12 in FIG. 11.
Figure 11:
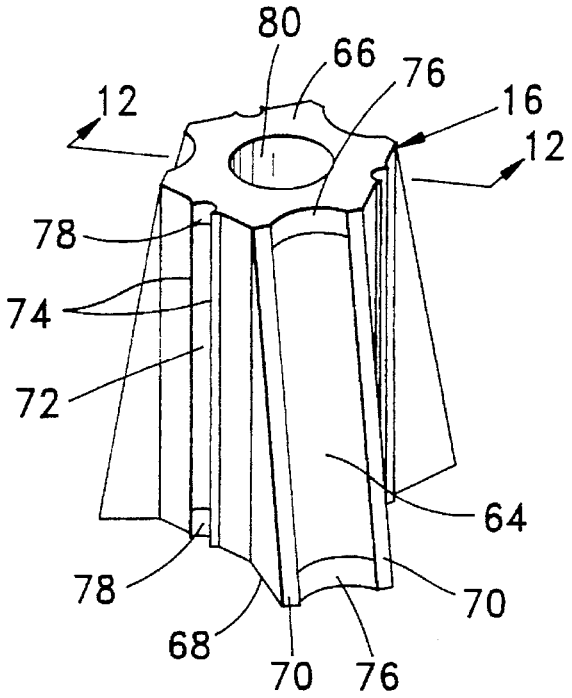
FIG. 11 is an isometric view of the wedge shown in FIG. 9.
Figure 9:
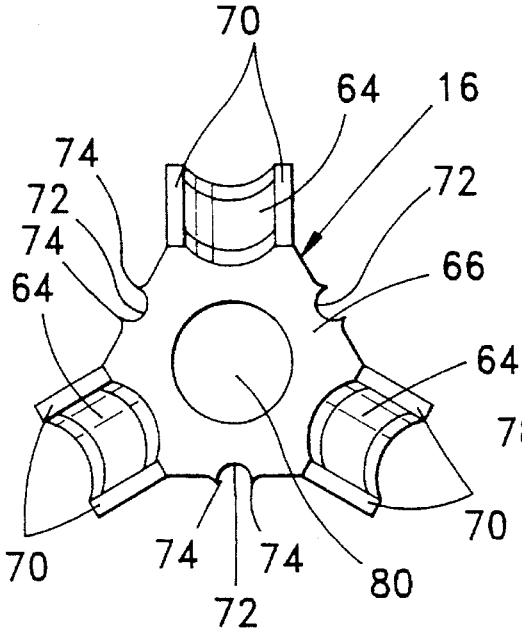
FIGS. 9 and 10 are left end and front views, respectively, of the wedge.
Figure 10:
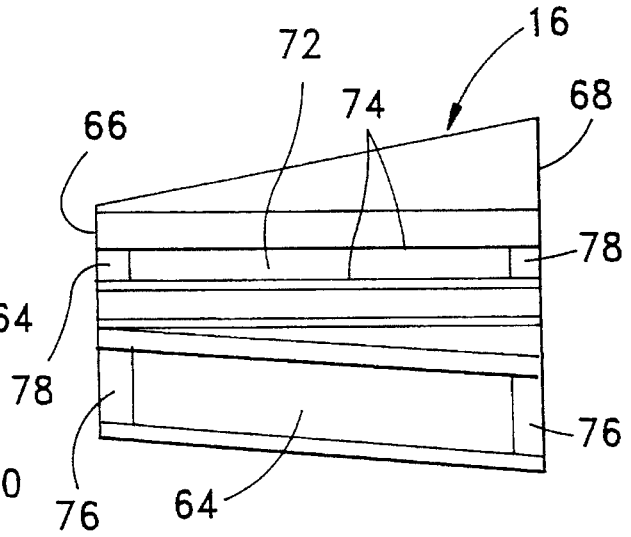

As shown in FIGS. 9 through 12, the wedge 16 includes three third channels 64 that extend from a first end 66 to a second end 68 of the wedge and mutually diverge toward the second end. The third channels diverge by an amount that is substantially the same as the divergence of the first channels 48 in the clamping member 14. Each third channel 64 includes an abutting surface 70 on each side thereof for abuttingly engaging respective abutting surfaces 52 of the clamping member 14 when the wedge is assembled to the clamping member without a first conductor in the respective first channel. The wedge 16 includes three fourth channels 72 which extend from the first end 66 to the second end 68, mutually diverging toward the second end in conformance to the amount of divergence of the second channels 54 of the clamping member 14. Each fourth channel 72 includes an abutting surface 74 on each side thereof for abuttingly engaging respective abutting surfaces 56 of the clamping member 14 when the wedge is assembled to the clamping member without a second conductor in the respective second channel. The third and fourth channels 64 and 72 are arranged to conform to the spacing of the first and second channels 48 and 54, respectively, so that when the wedge 16 is in operational engagement with the clamping member 14, as shown in FIGS. 1 and 2, each third channel is in opposing relationship with a respective first channel and each fourth channel is in opposing relationship with a respective second channel. Each of the third and fourth channels 64 and 72 have a pair of bevels 76 and 78, respectively, as best seen in FIGS. 10 and 11, to serve as lead in surfaces for the first and second conductors 18 and 20 and to lessen the chance of nicking the conductors during installation of the wire connector 10 and during use. A clearance hole 80, shown in FIGS. 9, 11, and 12, extends through the wedge 16 coaxial to the axis 34 when assembled to the clamping member 14, as shown in FIGS. 1 and 2. The hole 80 intersects a hexagonal opening 82, as best seen in FIGS. 3 and 12, that is sized to receive the nut 24. The nut 24 preferably, should be a slight interference fit with the opening 82. An optional variation of the wedge 16 is that the clearance hole 80 may be a threaded hole for threadingly receiving the bolt 22. This variation would, of course, render the nut 24 unnecessary. The wedge provides the primary current path for the interconnected first and second conductors so it must be made of a highly conductive low resistance material. It may be made of aluminum alloy, copper alloy, or any suitable electrically conductive material.

Figure 15:
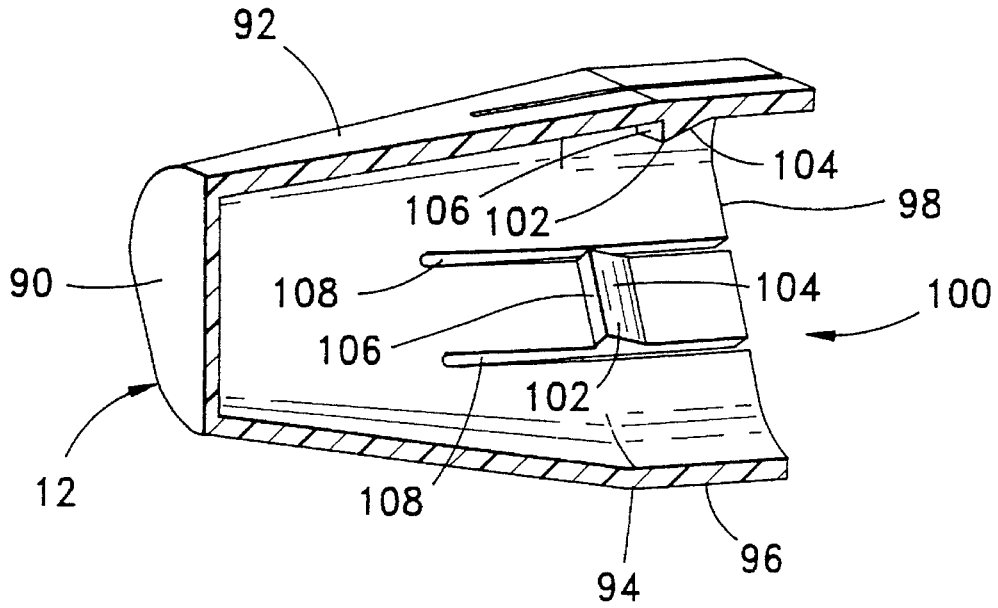
FIG. 15 is a cross-sectional isometric view taken along the lines 15—15 in FIG. 13.
Figure 13:
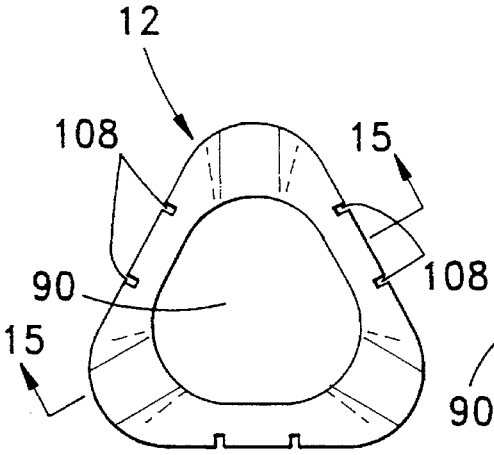
FIGS. 13 and 14 are left end and front views, respectively, of the cover.
Figure 14:
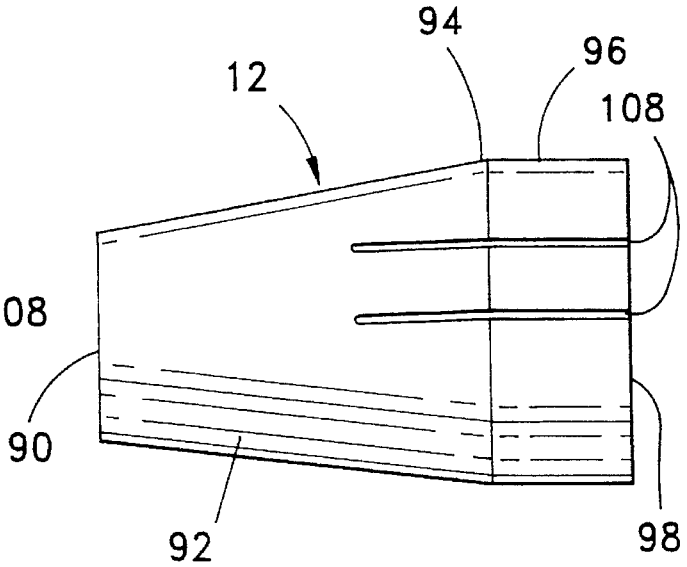

The cover 12, as shown in FIGS. 13, 14, and 15, has a closed end 90 and a side wall 92 extending from the closed end and tapering outwardly to terminate at a junction 94 with a shroud 96. The shroud 96 has substantially straight sides and terminates in an open end 98. The open end provides access to an interior cavity 100 of the cover 12, as best seen in FIG. 15, that is arranged to receive the assembled clamping member 14, wedge 16, and bolt 22, as shown in FIGS. 1 and 2. There are three latches 102 evenly spaced about an interior wall of the cover 12, each latch having a camming surface 104 facing the open end 98 and a latching surface 106 facing the closed end 90. While three latches 102 are shown, in the present example, a single latch 102 may be utilized without departing from the teachings of the present invention. Three such latches provide a more secure latching of the cover, however, they are more difficult to simultaneously release than would be a single latch, when the cover 12 is removed. A pair of slots 108 are formed in the shroud 96 and a portion of the wall 92 on opposite sides of and closely adjacent each latch 102. The portion of the wall that is between each of the pairs of slots 108 is sufficiently resilient that the latches may be elastically deflected outwardly as the clamping member 14 is inserted into the cavity 100 and then latch against the second end 32 of the clamping member 14. The cover 12 is made of any suitable plastic having good dielectric properties.

Figure 16:
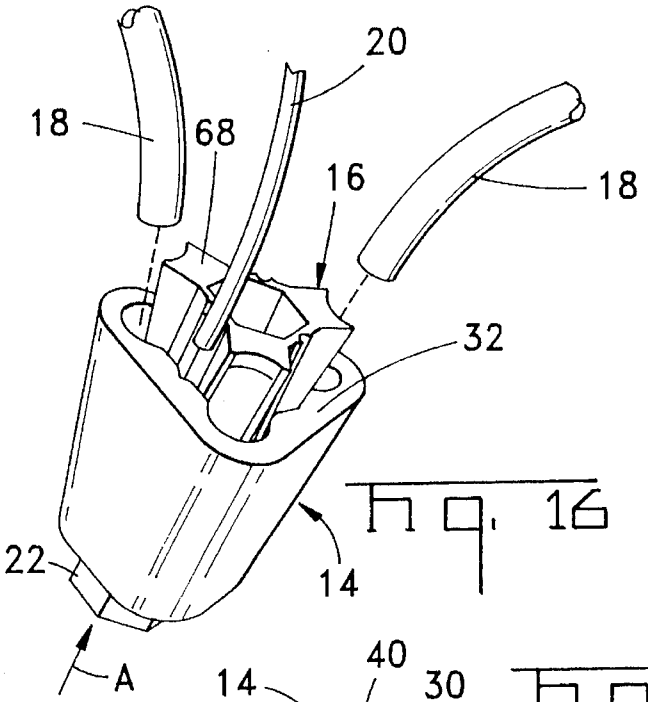
FIG. 16 is an isometric view of the wire connector partially assembled.
Figure 4:
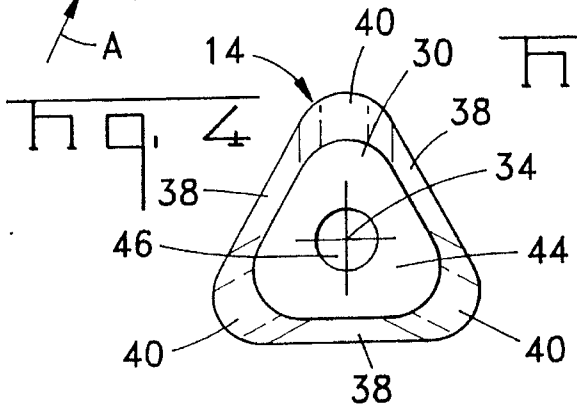

In operation, as shown in FIG. 16, the wire connector 10 is partially assembled with the end 68 of the wedge 16 extending out of the end 32 of the clamping member 14. The bolt 22 is in loose threaded engagement with the nut 24, so that the clamping member and wedge are held mutually captive, yet, by pushing the bolt 22 in the direction of the arrow A, the wedge 16 is made to extend outwardly as shown. The single second conductor 20 is inserted into the space between one of the second channels 54 and opposing fourth channel 72. Two first conductors 18 are then inserted into the space between two of the first channels 48 and their corresponding opposing third channels 64. The conductors 18 and 20 are fully inserted into the assembly, the wedge 16 is then carefully pushed further into the interior cavity 42 of the clamping member to take up the slack, and the bolt threaded further into the nut 24 and tightened. As the bolt is being tightened the third and fourth channels of the wedge 16 slidingly engage their respective first and second conductors 18 and 20. There is then a wiping action between the conductors and the wedge as the wedge is forced further into the cavity 42 by the bolt 22 and nut 24. This wiping action tends to break down any oxide layer that is present on the outer surfaces of the conductors that are in contact with the wedge. Additionally, as the bolt is tightened, the portions of the first and second conductors 18 and 20 that are within the channels 48 and 54 are forced into intimate electrical contact with substantially the entire length, about 1,250 inches in the present example, of their respective third and fourth channels 64 and 72. The somewhat soft conductors 18 and 22 are forcefully wedged between the wedge channels 64 and 72 and there respective clamping member channels 48 and 54 so that they deform slightly against the channel surfaces thereby establishing good electrical contact over a relatively large surface area. It will be understood that the current path of the finished connection is through the wedge. Where a conductor is absent from any of the first and second channels 48 and 54, the wedge abutting surfaces 70 or 74 abuttingly engage their respective clamping member abutting surfaces 52 and 56 so that the wedge is maintained in substantial centered alignment with the clamping member, as shown in FIG. 2. The assembled clamping member and wedge is then inserted into the cavity 100 of the cover 12. The interior of the cover 12 is sized and shaped to conform to the outside of the clamping member 14 so that when the clamping member and wedge are inserted, the camming surface 104 of each of the latches 102 engages the flat sides 38 of the clamping member 14. As insertion continues, the camming surfaces 104 ride up the tapered surfaces 38, deflecting the latches 102 outwardly until the clamping member is fully insert into the cavity. At this point the latches 102 elastically snap back into their original positions with the latching surfaces 106 in latching engagement with the end 32 of the clamping member, as shown in FIG. 1 and 2. The shroud 96 extends substantially beyond the end 32 of the clamping member and the end 68 of the wedge to form a strain relief and to protect the conductors 18 and 22 near the wire connector 10. This helps to prevent inadvertent kinking of the conductors by rough handling of the connector during installation and subsequent maintenance. The shroud provides additional protection against inadvertent shorting.

While, in the present example, a three sided polygon structure was described for the wire connector 10, a polygon structure of two sides or four or more sides may be utilized in the practice of the present invention. In the case of a two sided polygon structure, the wire connector would accommodate up to two first conductors 18 and up to two second conductors 20. A four sided polygon structure would accommodate up to four first conductors 18 and up to four second conductors 20, and so on. Note that it is not necessary to utilize all of the conductor channels in a given wire connector. Additionally, while an end wall 44 with a clearance hole 46 is provided, in the present example, the end wall would not be needed if the interior cavity 42 extended completely through the clamping member 14 thereby leaving both the first and second ends open. In this case the bolt 22 would have to include a washer or have a head large enough to engage the surface of the end 30 when assembling the wire connector. Further, the bolt 22 is not necessary to utilize the clamping member 14 and wedge 16 of the present invention. An external tool could be used to force the wedge into the interior of the clamping member and either friction or another fastener, such as a rivet, utilized to hold the wedge and clamping member in assembled position. Alternatively, the cover 12 may be eliminated by making the clamping member 14 from a high strength plastic having good dielectric properties. In this case the head of the bolt 22 would have to be in a counterbored hole in the clamping member to reduce the danger of the head shorting against adjacent equipment.

An important advantage of the present invention is that there is significantly more electrical contact area provided for each conductor and there is a wiping action between the wedge and the conductors during assembly which breaks down any oxide layers that may be present. There is no conductor to conductor contact thereby avoiding dissimilar metals problems. Additionally, The insulating cover protects the wire connector against shorts, and the entire connector is easily assembled and disassembled in the field without special tools.

I claim:

1. An electrical wire connector for electrically interconnecting at least one first conductor and one second conductor, comprising:

a clamp member having a first end, a second end, and a longitudinal axis extending through said first and second ends; a peripheral wall extending from said first end to said second end and completely encircling said axis, said wall having an outer surface and an inner surface defining an interior cavity; a substantially straight first conductor receiving channel and a substantially straight second conductor receiving channel formed in said interior wall, said first and second channels extending from said first end to said second end and said first channel diverging from said first end outwardly away from said axis toward said second end; and a wedge having a third channel and a fourth channel, said wedge to be conformably received in a closed position within said interior cavity of said clamping member wherein said third channel is in opposed relationship with said first channel for receiving and clamping a first conductor therebetween and said fourth channel is in opposed relationship with said second channel for receiving and clamping a second conductor therebetween, said clamping member including a plurality of first and second conductor receiving channels for receiving a plurality of first and second conductors respectively wherein each of said first conductors is of larger size than each of said second conductors;

whereby, upon moving said wedge into said closed position within said clamping member, said first and second conductors are clamped tightly into respective channels of said clamping member and said wedge.

2. The wire connector according to claim 1 wherein a portion of said wall adjacent said fourth channel elastically deflects when said wedge is forced into said closed position with a second conductor in said fourth channel.

3. The wire connector according to claim 1 wherein said wedge includes a plurality of third and fourth conductor receiving channels, each said third channel being in opposed relationship with a respective one of said first channels for receiving and clamping a first conductor therebetween, and each fourth channel being in opposed relationship with a respective one of said second channels for receiving and clamping a second conductor therebetween.

4. The wire connector according to claim 3 wherein said first and second channels are alternately spaced along said interior surface of said wall so that each second channel is between two first channels.

5. The wire connector according to claim 3 wherein each of said first and second channels is a concave surface formed in said interior surface.

6. The wire connector according to claim 5 wherein each of said third and fourth channels is a concave surface formed in an outer surface of said wedge.

7. The connector according to claim 6 wherein each of said third channels of said wedge includes an abutting surface on each side thereof arranged to abuttingly engage said interior surface of said wall of said clamping member in the absence of a first conductor in said third channel.

8. The wire connector according to claim 1 including a coupler arranged to force said wedge into said interior of said clamping member and into said closed position, said coupler securing said wedge and clamping member together.

9. The wire connector according to claim 8 wherein said coupler comprises a bolt extending through said first end of said clamping member, along said axis, and into threaded engagement with a threaded hole in said wedge.

10. The wire connector according to claim 9 wherein said first end of said clamping member is a closed end having a hole formed therethrough and said bolt extend through said hole.

11. The wire connector according to claim 10 wherein said threaded hole comprises a nut associated with said wedge.

12. The wire connector according to claim 1 including an electrically insulating cover having an interior conformably shaped to said outer surface of said clamping member so that said clamping member, said wedge in said closed position, and said bolt securing said wedge to said clamping member, are disposed completely within said interior of said cover.

13. The wire connector according to claim 12 wherein said cover includes a locking tab extending therefrom in interfering engagement with said clamping member, thereby securing said cover to said clamping member.

14. The wire connector according to claim 13 wherein said cover includes a resilient portion and said tab includes a beveled surface so that when said clamping member is inserted into said interior of said cover, said beveled surface of said tab is cammed against said clamping member thereby deflecting said tab and said resilient portion of said cover outwardly until said clamping member is completely within said interior, whereupon said tab is moved into said interfering engagement under the urging of said resilient portion of said cover.

15. The wire connector according to claim 3 wherein said clamping member has a cross section perpendicular to said axis that is substantially of polygonal shape.

16. The wire connector according to claim 15 wherein said cross section is substantially that of a three sided polygon and said clamping member has three first channels and three second channels.

17. The wire connector according to claim 15 wherein said clamping member has at least three first channels and at least three second channels.

* * * * *